US005891268A

United States Patent [19]

Hacias et al.

[11] Patent Number: 5,891,268

[45] Date of Patent: Apr. 6, 1999

[54] HIGH COATING WEIGHT IRON PHOSPHATING, COMPOSITIONS THEREFOR, AND USE OF THE COATING FORMED AS A LUBRICANT CARRIER

[75] Inventors: Kenneth J. Hacias, Sterling Heights; John M. Kukalis, Brighton, both of Mich.

[73] Assignee: Henkel Corporation, Gulph Mills, Pa.

[21] Appl. No.: 761,173

[22] Filed: Dec. 6, 1996

[51] Int. Cl.[6] ..... C23C 22/00

[52] U.S. Cl. ..... 148/246; 106/14.12; 106/14.41; 106/14.42; 106/14.44; 148/253; 148/257; 148/259; 148/260; 148/274; 148/516

[58] Field of Search ..... 148/246, 253, 148/257, 259, 260, 274, 516; 106/14.12, 14.41, 14.42, 14.44

[56] References Cited

U.S. PATENT DOCUMENTS

| | | | |
|---|---|---|---|
| 4,149,909 | 4/1979 | Hamilton | 148/260 |
| 4,285,223 | 8/1981 | Das et al. | 148/246 |
| 4,289,546 | 9/1981 | Hacias | 148/246 |
| 5,137,589 | 8/1992 | Kinkelaar | 148/259 |
| 5,143,562 | 9/1992 | Boulos | 148/247 |
| 5,234,509 | 8/1993 | Tull | 148/246 |
| 5,308,654 | 5/1994 | Nagae et al. | 427/239 |
| 5,366,567 | 11/1994 | Ogino et al. | 148/258 |
| 5,368,757 | 11/1994 | King | 252/34 |
| 5,531,912 | 7/1996 | Church et al. | 508/507 |
| 5,547,595 | 8/1996 | Hacias | 508/156 |

FOREIGN PATENT DOCUMENTS

WO9416119 7/1994 WIPO .

*Primary Examiner*—David A. Simmons
*Assistant Examiner*—Robert R. Koehler
*Attorney, Agent, or Firm*—Ernest G. Szoke; Wayne C. Jaeschke; Norvell E. Wisdom, Jr.

[57] ABSTRACT

Iron phosphate conversion coatings that are well adapted to serve as carriers for metal cold working lubricants, particularly such lubricants that contain polyoxyethylene adducts of long chain primary alcohols as a major lubricating component, can be formed on ferriferous surfaces within practical times such as 5 to 10 minutes by contact with an aqueous solution of almost neutralized phosphoric acid that has sufficient Free Acid and/or Total Acid content to form a heavier phosphate conversion coating than do conventional iron phosphating compositions. The phosphate conversion coating forming aqueous liquid composition advantageously also contains an accelerator component such as chlorate or hydroxylamine.

20 Claims, No Drawings

HIGH COATING WEIGHT IRON PHOSPHATING, COMPOSITIONS THEREFOR, AND USE OF THE COATING FORMED AS A LUBRICANT CARRIER

BACKGROUND OF THE INVENTION

1. Field of the Invention

This invention relates to forming iron phosphate conversion coatings, with substantially higher coating weights than are normal for iron phosphating, on ferriferous substrates, to compositions suitable for forming such coatings by contact with ferriferous metal substrates, and to use of the coatings formed as a carrier for lubricants during drawing and/or other forms of cold working of the coated substrates.

2. Discussion of Related Art

Iron phosphating is well established as a pre-painting treatment. For this purpose, phosphating compositions with a pH value higher than 3.8 are generally used, and the coating weights of the phosphate coatings formed are generally from 0.3 to 1.5 grams per square meter (hereinafter usually abbreviated as "$g/m^2$"). Phosphating is also well established as a process for forming a base surface on which to apply a lubricant, conventionally a soap such as zinc and/or sodium stearate, to prevent mechanical damage during cold working, especially tube drawing. For this purpose, however, much heavier coating weights of at least 2 $g/m^2$ and normally 6–9 $g/m^2$ are usually used. In the past, such coating weights have normally been achieved by using zinc containing phosphating compositions. Zinc phosphating compositions are highly effective for this purpose, but zinc and other "heavy" metals such as nickel and manganese that are often contained in zinc phosphating compositions are being increasingly regarded as pollutants, so that their elimination would be advantageous, if adequate lubricant carrier conversion coatings could be produced without them.

DESCRIPTION OF THE INVENTION

Objects of the Invention

A major object of the invention is to provide a phosphate conversion coating forming process and/or composition which will be less polluting than zinc phosphating as currently used for forming a lubricant carrier but will nevertheless provide adequate lubrication in combination with a suitable lubricant. Another concurrent or alternative object is to provide an iron phosphating process and/or composition that will achieve substantially higher coating weights than have generally been achieved with iron phosphating heretofore. Other objects will be apparent from the description below.

General Principles of Description

Except in the claims and the specific examples, or where otherwise expressly indicated, all numerical quantities in this description indicating amounts of material or conditions of reaction and/or use are to be understood as modified by the word "about" in describing the broadest scope of the invention. Practice within the numerical limits stated is generally preferred, however. Also, unless expressly stated to the contrary: percent, "parts of", and ratio values are by weight or mass; the term "polymer" includes "oligomer", "copolymer", "terpolymer", and the like; the first definition or description of the meaning of a word, phrase, acronym, abbreviation or the like applies to all subsequent uses of the same word, phrase, acronym, abbreviation or the like and applies, mutatis mutandis, to normal grammatical variations thereof; the description of a group or class of materials as suitable or preferred for a given purpose in connection with the invention implies that mixtures of any two or more of the members of the group or class are equally suitable or preferred; specification of materials in ionic form implies the presence of sufficient counterions to produce electrical neutrality for the composition as a whole; and any counterions thus implicitly specified preferably are selected from among other constituents explicitly specified in ionic form, to the extent possible; otherwise such counterions may be freely selected, except for avoiding counterions that act adversely to the object(s) of the invention.

SUMMARY OF THE INVENTION

It has been discovered that iron phosphating compositions containing no heavy metals can achieve one or more of the above stated goals of the invention when they are substantially more concentrated in Total Acid content than conventional iron phosphating compositions and/or have a pH below 4.2. With such compositions, coating weights of at least 1.7 $g/m^2$ can be consistently achieved, and such coating weights provide adequate lubricant carrier capacity for preferred cold working lubricants.

Accordingly, one major embodiment of the invention is a working conversion coating forming aqueous liquid composition that comprises, preferably consists essentially of, or more preferably consists of, water and:

(A) dissolved phosphate anions; and (B) dissolved monovalent cations exclusive of hydrogen ions, in an amount such that the Total Acid content is not greater than 260 points; and, optionally, (C) a component of accelerator, said working conversion coating forming aqueous liquid composition also having at least one of (i) a pH value not more than 4.2 and (ii) a phosphate ions content of at least 20 grams per liter (hereinafter usually abbreviated as "g/L") but not more than 125 g/L.

The Total Acid and Free Acid contents of the composition, consistent with general practice in the phosphating art, are expressed herein in "points", by which is meant the milliliters ("ml") of 0.1 N NaOH required to titrate a 10 ml aliquot sample of the composition, to a pH of 8.2 (e.g., with phenolphthalein indicator) for Total Acid and to a pH of 4.2 (e.g., with bromocresol green indicator) for Free Acid. If the initial pH is above 4.2, no titration for Free Acid as described above is made; instead a titration with 0.1 N strong acid is made, and the number of ml required for the titration to a pH value of 4.2 is defined as "points of Acid Consumed", which alternatively may be expressed as negative points of Free Acid.

Another major embodiment of the invention is a process comprising steps of:

(I) contacting a feriiferous metal substrate with a conversion coating forming aqueous liquid composition according to the invention as described above for a sufficient time at a sufficient temperature to form on the substrate a phosphate conversion coating with a coating weight of at least 1.7 $g/m^2$, thereby converting the substrate into a phosphate conversion coated substrate having a phosphate conversion coated surface; and (II) discontinuing contact between the phosphate conversion coated substrate prepared in part (I) and the conversion coating forming aqueous liquid composition recited in part (I); and, optionally, (III) applying to the phosphated conversion coated surface of the phosphate conversion coated substrate a lubricant layer forming composition and, optionally, drying the lubricant layer forming composition to provide a solid lubricant coating over the phosphate conversion coated surface, thereby converting it into a lubricant and phosphate conversion coated surface; and (IV) cold working the substrate in a manner that generates sliding contact between the lubricant and phosphate conversion coated surface and another solid surface.

Various additional embodiments of the invention include make-up concentrates from which working compositions for direct use in treating metals as described above to form a phosphate conversion coating thereon can be prepared by dilution with water, replenisher concentrates suitable for maintaining optimum performance of working compositions according to the invention, and extended processes including additional steps that are conventional per se, such as cleaning, rinsing, and the like. Articles of manufacture including surfaces treated according to a process of the invention are also within the scope of the invention.

DESCRIPTION OF PREFERRED EMBODIMENTS

For a variety of reasons, it is sometimes preferred that conversion coating forming aqueous liquid compositions according to the invention as defined above should be substantially free from many ingredients used in compositions for similar purposes in the prior art. Specifically, it is preferred, with increasing preference in the order given, independently for each preferably minimized component listed below, that these compositions contain no more than 9, 5, 3, 1.0, 0.35, 0.10, 0.08, 0.04, 0.02, 0.01, 0.001, or 0.0002, percent of each of the following constituents: organic compounds containing nitro groups; ferricyanide; ferrocyanide; pyrazole compounds; organic compounds containing two or more per molecule of moieties selected from the group consisting of (i) carbonyl moieties and (ii) hydroxyl, thiol and amino moieties that are not chemically bonded to a carbon atom that is part of a carbonyl moiety; and dissolved cations which comprise a metallic atom which has a valence of 2 or higher. The absence of other unnecessary components may also be preferred for economic reasons.

The dissolved phosphate ions that constitute necessary component (A) may be obtained from a variety of sources as known in the general phosphate conversion coating art. Because of a preference noted below for a substantial amount of total acid in a working conversion coating forming aqueous liquid composition according to the invention, normally much of the phosphate ions content will preferably be supplied by phosphoric acid added to the composition, and the stoichiometric equivalent as phosphate ions of all undissociated phosphoric acid and all its anionic ionization products in solution, along with the stoichiometric equivalent as phosphate ions of any dihydrogen, monohydrogen, or completely neutralized phosphate ions added to the composition in salt form, are to be understood as forming part of component (A), irrespective of the actual degree of ionization that exists in the composition. In a working conversion coating forming aqueous liquid composition according to the invention, the concentration of component (A) preferably is at least, with increasing preference in the order given, 22, 24.0, 25.0, 26.0, 27.0, 28.0, 29.0, 30.0, 31.0, 32.0, 32.5, 33.0, 33.5, 34.0, or 34.5 g/L and independently preferably is not more than, with increasing preference in the order given, 115, 105, 95, 90, 85, 80, 75, 70, 65, 60, 55, 50, 45, 40, 39.0, 38.0, 37.0, 36.5, 36.0, 35.5, 35.2, or 35.0 g/L.

The monovalent cations required for component (B) in a working conversion coating forming aqueous liquid composition according to the invention preferably, primarily for reasons of economy, are alkali metal cations, with sodium generally most preferred and potassium normally next most preferred, although potassium can be preferred over sodium for making exceptionally strong concentrate compositions according to the invention, because potassium phosphates are sufficiently more soluble than sodium phosphates in normal ambient temperature water to permit greater total concentrations of dissolved phosphate than are possible with sodium counterions.

In a working conversion coating forming aqueous liquid composition according to the invention, the content of Total Acid preferably is at least, with increasing preference in the order given, 15, 17, 19, 21, 23, 25, 27, 29, 31, 33, 35, 37, 39.0, or 39.5 points and independently preferably is not more than, with increasing preference in the order given, 140, 110, 90, 70, 60, 50, 45, 41.0, or 40.5 points. Independently, the content of Free Acid preferably is at least, with increasing preference in the order given, −1.0, −0.8, −0.60, −0.50, −0.40, −0.30, or −0.20 points and independently, if the substrates to be phosphate coated have been pickled or otherwise freed from substantially all visible oxide coatings, the Free Acid content preferably is not more than, with increasing preference in the order given, 15, 12, 10, 8, 6, 4.0, 3.0, 2.0, 1.8, 1.6, 1.4, 1.2, 1.0, 0.8, 0.60, 0.50, 0.40, 0.30, or 0.20 points. However, if the substrates have not been freed of all visible oxide, the Free Acid content preferably is at least 0.50, in order to aid in removal of light oxide layers.

The Free Acid and Total Acid contents can be adjusted into the preferred range, without disturbing the preferred values for other constituents of a conversion coating forming aqueous liquid composition according to the invention, by additions, to an otherwise satisfactory conversion coating forming aqueous liquid composition, of small amounts of strongly alkaline materials such as sodium and potassium hydroxides and carbonates, of strong acids such as nitric and sulfuric acids, or of amphoteric materials such as alkali metal mono- and di-hydrogen phosphates, as appropriate for the direction in which it is desired to change the Free Acid and Total Acid contents, in a manner generally known to those skilled in the art.

The presence in a conversion coating forming aqueous liquid composition according to the invention of optional accelerator component (C) is generally preferred. This component is preferably chosen from the group consisting of hydroxylanine (usually and preferably in the form of a water soluble salt or complex which provides hydroxylamine in solution via a dissociation reaction, rather than pure hydroxylamine itself), chlorate ions and bromate ions, and nitrite ions, more preferably hydroxylamine or chlorate ions.

When hydroxylamine sources are the predominant accelerator present in a conversion coating forming aqueous liquid composition according to this invention: (i) the chemical source of the hydroxylamine preferably is hydroxylamine sulfate, which has the chemical formula $(HONH_3)_2SO_4$; independently, (ii) the concentration of hydroxylamine in a conversion coating forming aqueous liquid composition according to the invention, expressed as its stoichiometric equivalent as hydroxylamine sulfate, preferably is at least, with increasing preference in the order given, not less than 0.5, 1.0, 1.5, 2.0, 2.5, or 3.0 g/L and independently preferably is not more than, with increasing preference in the order given, 20, 18, 16, 14, 12, 10.0, 9.0, 8.0, 7.0, 6.5, or 6.1 g/L; and independently, (iii) the Acid Ratio, which is defined as the ratio of (iii.1) the Total Acid content to (iii.2.1) 0.2 or (iii.2.2) the absolute value of the Free Acid content in points, whichever of (iii.2.1) and (iii.2.2) is larger, in a conversion coating forming aqueous liquid composition according to the invention preferably is at least, with increasing preference in the order given, 2:1.0, 4.0:1.0, 5.0:1.0, 6.0:1.0, 6.4:1.0, 6.7:1.0, or 6.9:1.0 and independently preferably is not more than, with increasing preference in the order given, 800:1.0, 700:1.0, 600:1.0, 500:1.0, 400:1.0, 300:1.0, 250:1.0, 200:1.0, 150:1.0, 100:1.0, 80:1.0, 60:1.0, 50:1.0, 40:1.0, 20:1.0, 18:1.0, 16:1.0, 14:1.0, 13:1.0, 12:1.0, 11:1.0, 10.5:1.0, or 10.1:1.0.

When chlorate ions are the predominant accelerator present in a conversion coating forming aqueous liquid composition according to the invention: (i) the chlorate ions are preferably derived from alkali metal chlorate salts, most preferably sodium chlorate; independently, (ii) the concentration of chlorate anions in a conversion coating forming aqueous liquid composition according to the invention preferably is at least, with increasing preference in the order given, 3.0, 4.0, 5.0, 6.0, 7.0, 8.0, 9.0, 10, 12, 14, 16, 18, 20, 22, 24, 26.0, 27.0, 28.0, 29.0, 30.0, 30.5, 31.0, or 31.4 g/L and independently preferably is not more than, with increasing preference in the order given, 100, 80, 60, 55, 50, 45, 40, 38, 36, 34.0, 33.0, 32.5, 32.0, or 31.6; and, independently, (iii) the Acid Ratio in a conversion coating forming aqueous liquid composition according to the invention preferably is at least 10, 12, 14, 16, 18, 20, 23, or 25 and independently preferably is not more than, with increasing preference in the order given, 800, 700, 600, 500, 450, 400, 350, 300, 250, 200, 180, 160, 140, 120, 100, 90, 80, 70, 50, 40, 35, 30, or 26.

The actual conversion coating forming step in a process according to this invention preferably is performed at a temperature that is at least, with increasing preference in the order given, 35, 40, 45, 50, 55, 60, 65, 70, or 73° C. and independently preferably is, primarily for reasons of economy, not more than 95, 90, 85, 80, or 75° C. Independently, the time of contact between the substrate to be conversion coated and a conversion coating forming aqueous liquid composition according to the invention preferably is at least, with increasing preference in the order given, 1.0, 2.0, 2.5, 3.0, 3.5, 4.0, 4.5, or 4.9 minutes (hereinafter usually abbreviated "min") and independently preferably is, primarily for reasons of economy, not more than 30, 25, 20, 15, 12, 10.0, 9.0, 8.0, 7.5, 7.0, 6.7, 6.4, 6.1, 5.8, 5.5, or 5.2 min. Independently of both these parameters and more importantly than either of them, the phosphate conversion coating weight achieved by a process according to the invention preferably is at least, with increasing preference in the order given, 2.0, 2.3, 2.6, 2.9, 3.3, 3.6, 3.9, 4.1, 4.4, or 4.7 g/m$^2$ and independently, primarily for reasons of economy, preferably is not more than, with increasing preference in the order given, 40, 30, 25, 20, 15, 12, 10, 9.0, 8.0, 7.0, or 6.5 g/m$^2$.

In a process according to the invention that includes optional steps (III) and (V) as described above, the lubricant applied in step (III) may be a conventional metal soap(s) lubricant. However, preferably a lubricant composition and process as described in one or more of the following U.S. Patents and Patent Applications would be used: U.S. Pat. No. 5,234,509 to Tull, U.S. Pat. No. 5,308,654 to Nagae et al., U.S. Pat. Nos. 5,366,567 and 5,368,757 to King, U.S. Pat. No. 5,531,912 to Church et al., and U.S. Pat. No. 5,547,595 to Hacias; U.S. application Ser. No. 08/242,530 filed May 13, 1994, and U.S. application Ser. No. 08/319,910 filed Oct. 7, 1994; and International Application PCT/US94/00212 designating the U.S. and filed Nov. 1, 1994. The entire specifications of all of these patents and applications, except to the extent that they may be inconsistent with any explicit statement herein, are hereby incorporated herein by reference.

The practice of this invention may be further appreciated by consideration of the following, non-limiting, working examples and comparison examples.

Group 1

The base phosphate conversion coating forming aqueous liquid composition for this group had the composition shown in Table 1 below. The base composition had a Total Acid content of 39.5 points and a Free Acid content of 1.0 points. A sample of Type 1028 steel tubing was cleaned in a solution of PARCO® Cleaner 2077X, a commercial alkaline product available from the Parker Amchem Div. of Henkel Corp., Madison Heights, Mich., rinsed, pickled for 3 seconds in 10% sulfuric acid solution in water at 71° C., again rinsed, and immersed for 5 min in the conversion coating forming aqueous liquid composition noted above while the latter was at 70° C. An iridescent, dust free phosphate conversion coating with a coating weight of 1.51 g/m$^2$ was formed.

The base composition was then modified by adding 85% phosphoric acid solution in water to it until the Total Acid content had increased to 45 points and the Free Acid content to 4.0 points. A second sample of the same type as above was then processed in the same way, except for the changed composition of the conversion coating forming aqueous liquid composition. The coating produced was similar in appearance to that produced with the unmodified base composition and had a coating weight of 1.41 g/m$^2$.

TABLE 1

| Component | Parts per Thousand of Component in the Base Composition |
|---|---|
| 50% sodium hydroxide in water | 52.5 |
| 75% orthophosphoric acid in water | 77 |
| 50% gluconic acid in water | 2.8 |
| 40% sodium xylene sulfonate in water | 17.5 |
| ANTAROX ™ LF-330 | 1.75 |
| TRITON ™ DF-16 | 2.8 |
| GAFAC ™ RP-710 | 8.75 |
| Hydroxylamine sulfate | 5.75 |
| p-nitrobenzene sulfonic acid | 6.7 |
| 70% hydrofluoric acid in water | 2.95 |
| Sodium fluoborate | 1.75 |
| Water | Balance |

Notes for Table 1

ANTAROX ™ LF-330 was commercially supplied by GAF Chemicals Corporation and is reported to be a modified linear aliphatic polyether detergent and wetting agent with low foaming tendency.

TRITON ™ DF-16 was commercially supplied by Rohm & Haas Company and is reported to be a modified polyethoxylated straight chain alcohol nonionic low foaming detergent.

GAFAC ™ RP-710 was commercially supplied by GAF Chemicals Corporation and is reported to be a complex organic phosphate anionic detergent and emulsifier with hydrotropic effect on low foaming nonionic surfactants.

The modified base composition was then further modified by addition of more 85% phosphoric acid as above until the Total Acid content was 54.4 points and the Free Acid content was 9.2 points, and the temperature of this twice modified conversion coating forming aqueous liquid composition was raised to 74° C. A third sample of the same type of steel tubing processed in the same way as before except for these noted changes was coated with a matte gray crystalline phosphate conversion coating with a coating weight of 2.56 g/m$^2$. A sample of Type 4140 alloy tubing processed in the same way, using this twice modified base composition, had a coating weight of 5.68 g/m$^2$.

Group 2

The base composition for this group was a solution of 63 g/L of 50% sodium hydroxide solution in water and 93 g/L of 85% orthophosphoric acid in water, with no other deliberately added ingredient except water. This composition had a Total Acid content of 40.6 points and a Free Acid content of 0.6 points and therefore an Acid Ratio of 67.7. A cold rolled steel panel cleaned in the same manner as for Group 1 but not pickled was immersed in this base composition for 5 min at 74° C.; the coating weight of the resulting conversion coating was only 0.06 g/m$^2$.

Enough 85% phosphoric acid solution in water to lower the Acid Ratio to 10.5 was then added to the base composition, and another sample substrate of the same type was processed in the same manner as before. Again the coating weight was only 0.06 g/m$^2$. However, after 6 g/L of hydroxylamine sulfate was added to this composition and a third sample substrate processed under otherwise identical conditions, the coating weight increased to 3.42 g/m$^2$. Further addition of 4.5 g/L of sodium m-nitrobenzene sulfonate to the composition as previously modified reduced the coating weight on a fourth otherwise identically processed substrate sample to 1.52 g/m$^2$.

Further experiments along the same lines as those above established that desirably high coating weights are reliably produced in predominantly neutralized phosphoric acid conversion coating forming aqueous liquid compositions when the acid ratio is in the range from about 7 to about 10 and there are from about 3 to about 6 g/L of hydroxylamine sulfate also present in the compositions. The coatings produced usually have a dusty appearance, but this is not usually disadvantageous when the phosphate conversion coating produced is to be used as a lubricant carrier. The addition of m-nitrobenzene sulfonate to a conversion coating forming aqueous liquid composition otherwise containing only phosphoric acid, phosphate ions, alkali metal ions, hydroxylamine sulfate, and water reduced both the coating weight obtained and the dustiness of the coatings. Addition of gluconic acid further reduced the coating weight and essentially eliminated dustiness.

Group 3

The working phosphate conversion coating forming aqueous liquid compositions for this group contained the following ingredients in addition to water: 22 or 36 g/L of orthophosphoric acid (to produce 21 or 34 points of Total Acid respectively), 2.8 g/L of sodium nitrate, 40 g/L of sodium chlorate, and about 18 g/L of sodium carbonate, the amount of the latter being adjusted as necessary so that the Free Acid content was within the range from −0.2 to 0.2 points. S.A.E. Type 1026 carbon steel tubes, after cleaning as described for Group 1 but without pickling, were treated with these compositions at the temperatures shown in Table 2 below for 5 minutes to produce the coating weights also shown in Table 2.

TABLE 2

| Total Acid Points | Temperature, °C. | Coating Weight, g/m$^2$ |
|---|---|---|
| 21 | 43 | 1.1 |
| 34 | 49 | 2.2–3.2 |
| 34 | 60 | 5.4–6.4 |

After being phosphate coated as noted, the tubes were coated with 6.4 to 8.6 g/m$^2$ (dry mass) of a lubricating composition substantially as taught in Table 1 of U.S. Pat. No. 5,547,595 of Aug. 28, 1996 to Hacias. The lubricant coated tubes were drawn over a mandrel, all under the same mechanical conditions, to produce a 42% reduction in total cross-sectional area. None of the tubes with a phosphate coating weight of only 1.1 g/m$^2$ were drawn satisfactorily; about a quarter of those with the intermediate coating weight were drawn satisfactorily; and all of the tubes with at least 5.4 g/m$^2$ of phosphate coating were drawn satisfactorily.

Group 4

In this group of examples, working phosphating compositions consisting of 2.9–3.1% of $PO_4^-$ions (from phosphoric acid), 1.2–1.8% of $ClO_3^-$ions (from sodium chlorate), 0.3% of sodium nitrate, sodium carbonate as needed, and the balance water, with Total Acid points of 32–34 and an Acid Ratio of 10–15 were used. Coating weights obtained on SAE Type 1026 carbon steel tubes during 5 min of immersion in these compositions at 54° C. were from 4.6–4.9 g/m$^2$.

The invention claimed is:

1. An aqueous liquid composition of matter suitable for forming a phosphate conversion coating on a ferriferous metal substrate by contact therewith, said composition comprising water and:

(A) dissolved phosphate anions; and (B) dissolved monovalent cations exclusive of hydrogen ions, in an amount such that the Total Acid content is not greater than about 260 points;

said aqueous liquid composition also having at least one of (i) a pH value not more than about 4.2 and (ii) a phosphate ions content of at least about 20 g/L but not more than about 125 g/L, said aqueous liquid compositions not comprising more than about 0.10% of cations comprising a metallic atom which has a valence of 2 or higher.

2. A composition according to claim 1, which additionally comprises a source of hydroxylamine in a concentration stoichiometrically corresponding to from about 1.0 to about 10.0 g/L of hydroxylamine sulfate and has a Total Acid content measured in points, a Free Acid content measured in points, any an Acid Ratio, the Add Ratio being defines as the ratio of Total Acid content measured in points to the absolute value of Free Acid content measured in points if the absolute value of the Free Acid Content measured in points is at least 0.2 and being defined as the ratio of the Total Acid content measured in points to the number 0.2 if the absolute value of the Free Acid content measured in points less than 0.2 said Acid Ratio for the composition being in a range from about 2.0:1.0 to about 20:1.0.

3. A composition according to claim 2, wherein phosphate ions are present in a concentration from about 22 to about 70 g/L, the source of hydroxylamine is present in a concentration stoichiometrically corresponding to from about 2.0 to about 8.0 g/L of hydroxylamine sulfate, the Total Acid points are from about 23 to about 50, and the Acid Ratio is from about 5.0:1.0 to about 13:1.0.

4. A composition according to claim 3, wherein phosphate ions are present in a concentration from about 32.0 to about 38.0 g/L, the hydroxylamine source is present in a concentration stoichiometrically corresponding to from about 2.0 to about 8.0 g/L of hydroxylamine sulfate, the Total Acid points are from about 33 to about 45, and the Acid Ratio is from about 6.7:1.0 to about 10.5:1.0.

5. A composition according to claim 1, which additionally comprises chlorate ions in a concentration from about 3 to about 60 g/L and has an Acid Ratio in a range from about 10.0:1.0 to about 800:1.0.

6. A composition according to claim 5, wherein phosphate ions are present in a concentration from about 22 to about 70 g/L, chlorate ions are present in a concentration from about 10 to about 45 g/L, the Total Acid points are from about 23 to about 50, and the Acid Ratio is from about 16:1.0 to about 180:1.0.

7. A composition according to claim 6, wherein phosphate ions are present in a concentration from about 32.0 to about 38.0 g/L, chlorate ions are present in a concentration from about 26.0 to about 33.0 g/L, the Total Acid points are from about 33 to about 45, and the Acid Ratio is from about 20:1.0 to about 100:1.0.

8. A process of forming a phosphate conversion coating on a ferriferous metal substrate, said process comprising steps of:

(I) contacting a ferriferous metal substrate with a conversion coating forming aqueous liquid composition comprising water and:

(A) dissolved phosphate anions; and (B) dissolved monovalent cations exclusive of hydrogen ions, in an amount such that the Total Acid content is not greater than about 260 points;

said aqueous liquid composition also having at least one of (i) a pH value not more than about 4.2 and (ii) a phosphate ions content of at least about 20 g/L but not more than about 125 g/L, said aqueous liquid compositions not comprising more than about 0.10% of cations comprising a metallic atom which has a valence of 2 or higher, for a sufficient time at a sufficient temperature to form on the substrate a phosphate conversion coating with a coating weight of at least 1.7 $g/m^2$, thereby converting the substrate into a phosphate conversion coated substrate having a phosphate conversion coated surface; and (II) discontinuing contact between the phosphate conversion coated substrate prepared in part (I) and the conversion coating forming aqueous liquid composition recited in part (I).

9. A process according to claim 8, wherein:

said aqueous liquid composition additionally comprises a source of hydroxylamine in a concentration stoichiometrically corresponding to from about 1.0 to about 10.0 g/L of hydroxylamine sulfate and has: a Total Acid content measure in points a Free Acid content measured in points, and an Acid Ratio, the Acid Ratio being defined as the ratio of Total Acid content measured in points to the absolute value of the Free Acid content measured in points if the absolute value of the Free Acid Content measured in points is at least 0.2 and being defined as the ratio of the Total Acid content measured in points to the number 0.2 if the absolute value of the Free Acid content measured in points is less than 0.2, said Acid Ratio for the composition being in a range from about 2.0:1.0 to about 20:1.0;

step (I) is performed at a temperature of at least 40° C.; and contact during step (I) is maintained for a time of at least 2.0 min.

10. A process according to claim 9, wherein, in said aqueous liquid composition: phosphate ions are present in a concentration from about 22 to about 70 g/L, the hydroxylamine source is present in a concentration stoichiometrically corresponding to from about 2.0 to about 8.0 g/L of hydroxylamine sulfate, the Total Acid points are from about 23 to about 50, and the Acid Ratio is from about 5.0:1.0 to about 13:1.0.

11. A process according to claim 10, wherein: (1) in said aqueous liquid composition: (1.1) phosphate ions are present in a concentration from about 32.0 to about 38.0 g/L; (1.2) the hydroxylamine source is present in a concentration stoichiometrically corresponding to from about 2.0 to about 8.0 g/L of hydroxylamine sulfate; (1.3) the Total Acid points are from about 33 to about 45; and (1.4) the Acid Ratio is from about 6.7:1.0 to about 10.5:1.0; and (2) step (I) is performed at a temperature from about 70 to about 80° C.; and contact during step (I) is maintained for a time of at least 4.0 min.

12. A process according to claim 8, wherein: said aqueous liquid composition additionally comprises chlorate ions in a concentration from about 3 to about 60 g/L and has an Acid Ratio in a range from about 10.0:1.0 to about 800:1.0; step (I) is performed at a temperature of at least 40° C.; and contact during step (I) is maintained for a time of at least 2.0 min.

13. A process according to claim 12, wherein, in said aqueous liquid composition: phosphate ions are present in a concentration from about 22 to about 70 g/L, chlorate ions are present in a concentration from about 10 to about 45 g/L, the Total Acid points are from about 23 to about 50, and the Acid Ratio is from about 16:1.0 to about 180:1.0.

14. A process according to claim 13, wherein: (1) in said aqueous liquid composition: (1.1) phosphate ions are present in a concentration from about 32.0 to about 38.0 g/L; (1.2) chlorate ions are present in a concentration from about 26.0 to about 33.0 g/L; (1.3) the Total Acid points are from about 33 to about 45; and (1.4) the Acid Ratio is from about 20:1.0 to about 100:1.0; (2) step (I) is performed at a temperature from about 70 to about 80° C.; and (3) contact during step (I) is maintained for a time of at least 4.0 min.

15. A process for preparing a ferriferous metal substrate for cold working, said process comprising a process according to claim 14 and two additional steps as follows:

(III) applying to the phosphated conversion coated surface of the phosphate conversion coated substrate a lubricant layer forming composition and, optionally, drying the lubricant layer forming composition to provide a solid lubricant coating over the phosphate conversion coated surface, thereby converting it into a lubricant and phosphate conversion coated surface; and (IV) cold working the substrate in a manner that generates sliding contact between the lubricant and phosphate conversion coated surface and another solid surface.

16. A process for preparing a ferriferous metal substrate for cold working, said process comprising a process according to claim 13 and two additional steps as follows:

(III) applying to the phosphated conversion coated surface of the phosphate conversion coated substrate a lubricant layer forming composition and, optionally, drying the lubricant layer forming composition to provide a solid lubricant coating over the phosphate conversion coated surface, thereby converting it into a lubricant and phosphate conversion coated surface; and (IV) cold working the substrate in a manner that generates sliding contact between the lubricant and phosphate conversion coated surface and another solid surface.

17. A process for preparing a ferriferous metal substrate for cold working, said process comprising a process according to claim 12 and two additional steps as follows:

(III) applying to the phosphated conversion coated surface of the phosphate conversion coated substrate a lubricant layer forming composition and, optionally, drying the lubricant layer forming composition to provide a solid lubricant coating over the phosphate conversion coated surface, thereby converting it into a lubricant and phosphate conversion coated surface; and (IV) cold working the substrate in a manner that generates sliding contact between the lubricant and phosphate conversion coated surface and another solid surface.

18. A process for preparing a ferriferous metal substrate for cold working, said process comprising a process according to claim 11 and two additional steps as follows:

(III) applying to the phosphated conversion coated surface of the phosphate conversion coated substrate a lubricant layer forming composition and, optionally, drying the lubricant layer forming composition to provide a solid lubricant coating over the phosphate conversion coated surface, thereby converting it into a lubricant and phosphate conversion coated surface; and (IV) cold working the substrate in a manner that generates sliding contact between the lubricant and phosphate conversion coated surface and another solid surface.

19. A process for preparing a ferriferous metal substrate for cold working, said process comprising a process according to claim 10 and two additional steps as follows:

(III) applying to the phosphated conversion coated surface of the phosphate conversion coated substrate a lubricant layer forming composition and, optionally, drying the lubricant layer forming composition to provide a solid lubricant coating over the phosphate conversion coated surface, thereby converting it into a lubricant and phosphate conversion coated surface; and (IV) cold working the substrate in a manner that generates sliding contact between the lubricant and phosphate conversion coated surface and another solid surface.

20. A process for preparing a ferriferous metal substrate for cold working, said process comprising a process according to claim 8 and two additional steps as follows:

(III) applying to the phosphated conversion coated surface of the phosphate conversion coated substrate a lubricant layer forming composition and, optionally, drying the lubricant layer forming composition to provide a solid lubricant coating over the phosphate conversion coated surface, thereby converting it into a lubricant and phosphate conversion coated surface; and (IV) cold working the substrate in a manner that generates sliding contact between the lubricant and phosphate conversion coated surface and another solid surface.

* * * * *